US010513762B2

(12) United States Patent
Balichev et al.

(10) Patent No.: US 10,513,762 B2
(45) Date of Patent: Dec. 24, 2019

(54) COLD-ROLLED FLAT STEEL PRODUCT FOR DEEP DRAWING APPLICATIONS AND METHOD FOR PRODUCTION THEREOF

(71) Applicant: ThyssenKrupp Steel Europe AG, Duisburg (DE)

(72) Inventors: Evgeny Balichev, Dusseldorf (DE); Harald Hofmann, Dortmund (DE); Jose Jimenez, Madrid (ES)

(73) Assignee: THYSSENKRUPP STEEL EUROPE AG, Duisburg (DE)

( * ) Notice: Subject to any disclaimer, the term of this patent is extended or adjusted under 35 U.S.C. 154(b) by 607 days.

(21) Appl. No.: 14/767,741

(22) PCT Filed: Feb. 13, 2014

(86) PCT No.: PCT/EP2014/052810
§ 371 (c)(1),
(2) Date: Aug. 13, 2015

(87) PCT Pub. No.: WO2014/125016
PCT Pub. Date: Aug. 21, 2014

(65) Prior Publication Data

US 2016/0017467 A1 Jan. 21, 2016

(30) Foreign Application Priority Data

Feb. 14, 2013 (EP) ..... 13155225

(51) Int. Cl.

| | |
|---|---|
| ***C22C 38/06*** | (2006.01) |
| ***C22C 38/50*** | (2006.01) |
| ***C21D 8/04*** | (2006.01) |
| ***C21D 9/48*** | (2006.01) |
| ***C22C 38/12*** | (2006.01) |
| ***C22C 38/14*** | (2006.01) |
| ***C21D 1/26*** | (2006.01) |
| ***C21D 6/00*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/44*** | (2006.01) |
| ***C22C 38/46*** | (2006.01) |
| ***C22C 38/48*** | (2006.01) |

(52) U.S. Cl.
CPC ..... *C22C 38/50* (2013.01); *C21D 1/26* (2013.01); *C21D 6/004* (2013.01); *C21D 6/005* (2013.01); *C21D 6/008* (2013.01); *C21D 8/0263* (2013.01); *C21D 8/0405* (2013.01); *C21D 9/46* (2013.01); *C21D 9/48* (2013.01); *C22C 38/001* (2013.01); *C22C 38/004* (2013.01); *C22C 38/02* (2013.01); *C22C 38/04* (2013.01); *C22C 38/06* (2013.01); *C22C 38/12* (2013.01); *C22C 38/14* (2013.01); *C22C 38/44* (2013.01); *C22C 38/46* (2013.01); *C22C 38/48* (2013.01); *C21D 8/0226* (2013.01); *C21D 8/0236* (2013.01); *C21D 2211/004* (2013.01); *C21D 2211/005* (2013.01)

(58) Field of Classification Search
CPC ..... C22C 38/50
See application file for complete search history.

(56) References Cited

U.S. PATENT DOCUMENTS

| | | | | |
|---|---|---|---|---|
| 4,334,923 | A | 6/1982 | Sherman | |
| 6,383,662 | B1 * | 5/2002 | Frommeyer | C22C 38/06 420/127 |
| 9,580,766 | B2 * | 2/2017 | Perlade | C21D 8/021 |
| 2010/0300585 | A1 | 12/2010 | Perlade et al. | |

FOREIGN PATENT DOCUMENTS

| | | | |
|---|---|---|---|
| EP | 0826787 | A2 | 3/1998 |
| GB | 1044801 | | 10/1966 |
| JP | 408130 | | 8/1965 |
| JP | 2001164336 | A | 6/2001 |
| JP | 2001271136 | A | 10/2001 |
| JP | 2001271148 | A | 10/2001 |
| JP | 2006118000 | A | 5/2006 |
| JP | 2007321168 | A | 12/2007 |
| JP | 2009120962 | A | 6/2009 |
| JP | 2010121213 | A | 6/2010 |

OTHER PUBLICATIONS

English machine translation of JP 2010-121213 A of Masaharu Oka published Jun. 3, 2010 (Year: 2010).*
English machine translation of JP 2006-118000 A of Fujita et al. published May 11, 2006 (Year: 2006).*
Brux et al., Tiefziehfahige Eisen-Aluminium-Leichtbaustahle [Iron-Aluminum-Light-Weight-Steels for deep drawing applications], Konstruktion, Apr. 4, 2002, pp. 81-83.
Brux et al., Light-weight steels based on iron-aluminum—influence of micro alloying elements (B, Ti, Nb) on microstructures, textures and mechanical properties, Steel Research, Dec. 1, 2002, pp. 543-548, No. 12, Duesseldorf, DE.

* cited by examiner

*Primary Examiner* — Jophy S. Koshy
(74) *Attorney, Agent, or Firm* — The Webb Law Firm

(57) ABSTRACT

A cold-rolled flat steel product for deep drawing applications including in addition to Fe and unavoidable impurities (in % by weight) C: 0.008%-0.1%, Al: 6.5%-12%, Nb: 0.1%-0.2%, Ti: 0.15-0.5%, P: <0.1%, S: <0.03%, N: <0.1% and optionally one or more elements from the group of Mn, Si, REM, Mo, Cr, Zr, V, W, Co, Ni, B, Cu, Ca, N, where 2.5≥% Ti/% Nb≥1.5. Also a method of producing such a flat steel product including casting a pre-product, which is then hot-rolled into a hot strip with a hot rolling end temperature of 820-1000° C. and wound at a winding temperature of up to 750° C. After winding, the hot strip is annealed at an annealing temperature of >650-1200° C. for 1-50 h, then cold-rolled in one or more stages with a total cold rolling level of ≥65% and finally annealed at 650-850° C.

14 Claims, No Drawings

COLD-ROLLED FLAT STEEL PRODUCT FOR DEEP DRAWING APPLICATIONS AND METHOD FOR PRODUCTION THEREOF

CROSS-REFERENCE TO RELATED APPLICATIONS

This application is the United States national phase of International Application No. PCT/EP2014/052810 filed Feb. 13, 2014, and claims priority to European Patent Application No. 13155225.9 filed Feb. 14, 2013, the disclosures of which are hereby incorporated in their entirety by reference.

BACKGROUND OF THE INVENTION

Field of the Invention

The invention relates to a cold-rolled flat steel product for deep drawing applications, having a reduced weight as a result of a reduction in density combined with optimized mechanical properties and optimized formability. The invention likewise relates to a method for producing such a flat steel product.

Description of Related Art

Where flat steel products are mentioned here, this means steel strips obtained by rolling operations, steel sheets, and blanks, precut pieces and the like that have been obtained therefrom.

If figures relating to the content of an alloy element are given here in connection with an alloying method, these relate to the weight, unless explicitly stated otherwise.

Especially in the case of flat steel products used in the field of motor vehicle construction, not only the ratio of strength to formability but also physical properties such as stiffness and density are of particular significance with regard to the general aim of weight saving and improvement in the intrinsic frequencies of the respective motor vehicle. Distinct minimization of the density, accompanied by minimization of weight, can be achieved in the case of steels by addition of greater contents of lightweight Al to the alloy. In the case of sufficiently high Al contents, in addition, the initial order phase (K state) or Fe3Al (D03) order phase occurs, and these have particle-hardening, strength-enhancing and ductility-reducing effects.

The application-related advantages of ferritic Fe—Al steels having high Al contents of the kind in question here are opposed by the difficulties in production and processing. Thus, practical experience shows that any non-recrystallized strip core region in the hot strip produced from steels of this kind has to be reduced, since difficulties can otherwise occur in the trimming and in the cold rolling of the hot strip. Furthermore, complex operations are necessary in the prior art in order to avoid anisotropic cold strip properties because of an unsuitable cold strip texture. Anisotropism of this kind is characterized by low r and n values, and entails a low elongation at break. This results in problematic forming and processing characteristics of cold-rolled flat steel products produced from Fe—Al steels having high Al contents.

The problems summarized above increase with rising Al content and therefore limit the reduction in density achievable to date. It is thus considered in industry that Al-containing deep-drawable steels may contain a maximum of 6.5% by weight of Al (see U. Brüx "Tiefziehfähige Eisen-Aluminium-Leichtbaustähle" [Deep-drawable lightweight iron-aluminum steels], Konstruktion April 4, 2002).

SUMMARY OF THE INVENTION

Against the background of the prior art elucidated above, it was an object of the present invention to provide a flat steel product which, coupled with a distinct reduction in weight, has optimized suitability for forming and likewise optimized mechanical properties.

In addition, a method for producing such a flat steel product was to be specified.

A cold-rolled flat steel product of the invention for deep drawing applications consists of a steel which, in addition to iron and unavoidable impurities (in % by weight) contains C: 0.008%-0.1%, Al: 6.5%-12%, Nb: 0.1%-0.2%, Ti: 0.15%-0.5%, P: up to 0.1%, S: up to 0.03%, N: up to 0.1% and optionally one or more elements from the group of "Mn, Si, rare earth metals, Mo, Cr, Zr, V, W, Co, Ni, B, Cu, Ca, N", provided that Mn: up to 1%, rare earth metals: up to 0.2%, Si: up to 2%, Zr: up to 1%, V: up to 1%, W: up to 1%, Mo: up to 1%, Cr: up to 3%, Co: up to 1%, Ni: up to 2%, B: up to 0.1%, Cu: up to 3%, Ca: up to 0.015%. The % Ti/% Nb ratio of the Ti content % Ti and the Nb content % Nb is $$2.5 \geq \%\ Ti/\%\ Nb \geq 1.5,$$

especially $$2.2 \geq \%\ Ti/\%\ Nb \geq 1.8.$$

In the alloying method envisaged in accordance with the invention for a flat steel product of the invention, apart from iron, only Al and titanium and niobium are obligatory constituents.

DESCRIPTION OF THE INVENTION

The cold-rolled steel strip of the invention features r values of at least 1.3, and flat steel products of the invention regularly achieve r values greater than 1.3. The high r value represents good deep-drawability of the cold-rolled flat steel product of the invention, since the tendency to thin out in the course of deep drawing is reduced with rising r value, accompanied by enablement of greater degrees of deep drawing. There would otherwise be the risk of component failure at the site of thinning.

A cold-rolled flat steel product of the invention does not just have high r values but also achieves an elongation A50 of regularly more than 18%. Flat steel products of the invention produced under optimal processing conditions have elongations A50 of 25% or more.

At the same time, it is a characteristic feature of the microstructure of a flat steel product of the invention that that it is completely ferritic and very substantially free of κ-carbides (Fe—Al—C carbides). Accordingly, the κ-carbide content of a flat steel product of the invention is 0% by volume (completely κ-carbide-free state) to at most 0.1% by volume. The minimized κ-carbide content assures reliable processibility of the flat steel product of the invention.

It is a further feature of a flat steel product having a composition in accordance with the invention that the grains in its microstructure are globulitic by nature. At the same time, the ratio of particle length in rolling direction to particle width in transverse direction of the strip is generally less than 1.5, especially less than 1.2. In other words, the length of the grains is a maximum of 50%, especially not more than 20%, greater than their width.

As well as the obligatory constituents, the steel of the invention may contain a multitude of further alloying elements in order to establish particular properties. Useful elements for this purpose are summarized in the group of "Mn, Si, rare earth metal, Mo, Cr, Zr, V, W, Co, Ni, B, Cu, Ca, N". Each of these optionally added alloying elements may be present or entirely absent in the steel of the invention and the particular element should also be regarded as "absent" when it is present in the flat steel product of the invention in an amount in which it is ineffective and can therefore be counted among the impurities that are an unavoidable result of the production.

Aluminum is present in the steel of the invention in contents of 6.5%-12% by weight, advantageous Al contents being more than 6.8% by weight with regard to the desired reduction in density. Typical Al contents of flat steel products of the invention are within the range of 6.5%-10% by weight, especially 6.8%-9% by weight. The presence of high Al contents reduces the density of the steel and distinctly improves the corrosion resistance and oxidation resistance thereof. At the same time, Al in these contents increases the tensile strength. However, excessively high contents of Al can lead to a deterioration in the forming characteristics, expressed in a decrease in the r value. In order to minimize the adverse effects of Al, the Al content is therefore restricted to a maximum of 12% by weight. An optimized ratio of reduced density and processibility is established when 6.5%-10% by weight of Al, especially at least 6.8% by weight of Al, is present in the steel of the invention.

The C content in steel of the invention is restricted to at most 0.1% by weight, particularly favorable C contents being 0.015%-0.05% by weight, especially 0.008%-0.05% by weight. C contents above 0.1% by weight can cause the formation of unwanted brittle kappa-carbides ("κ-carbides") at the particle boundaries and cause a resulting decrease in hot and cold formability.

The avoidance of the formation of κ-carbides (Fe—Al—C compounds) is of particular significance for the steel of the invention. κ-Carbides form at the particle boundaries at an early stage during the hot processing in the course of processing of generic steels at high temperatures and cause embrittlement of the material. The addition of carbide-forming alloying elements which is made within the scope of the requirements of the invention sets a very low free C content and thus substantially prevents the formation of κ-carbides.

In the steel of the invention, for this purpose, primarily 0.15%-0.5% by weight of Ti and 0.1%-0.2% by weight of Nb are present. At the same time, the effect of titanium can be utilized in a particularly operationally reliable manner when the Ti content is 0.15%-0.3% by weight. The same applies to niobium when Nb is present in the steel of the invention in contents 0.1%-0.15% by weight. At the same time, the respective Ti and Nb contents have to be adjusted such that they fulfill the condition stipulated in accordance with the invention for the ratio of these contents. Ti and Nb contents which fulfill these requirements bring about the formation in the steel of the invention of finely dispersed Ti and Nb carbides which promote the formation of a fine microstructure that promotes the formability of the flat steel product. At the same time, free carbon is bound, and this could otherwise lead to formation of Fe—Al—C carbides which hinder formability and entail the risk of embrittlement. In the case of excessively high contents of Ti and Nb, however, unwanted deposits of these elements can form in the steel, which could cause a decrease in toughness and formability.

V, Zr and W are likewise effective carbide formers and may, each in contents of up to 1% by weight, supplement the effect of the obligatory contents of Nb and Ti envisaged in accordance with the invention. The effect of V, Zr and W can be exploited in a particularly target-oriented manner when the content of each is restricted to up to 0.5% by weight, especially 0.3% by weight.

The addition of Mn in contents of up to 1% by weight, especially up to 0.5% by weight, can improve the hot formability and weldability of the steel of the invention. Furthermore, Mn promotes deoxidation in the course of melting and contributes to an increase in the strength of the steel. These positive effects of Mn can be exploited in a particularly effective manner when the Mn content is 0.05%-0.5% by weight.

Mo may be present in the steel of the invention in contents of up to 1% by weight in each case. Mo likewise forms carbides and contributes to an increase in tensile strength, creep resistance and fatigue resistance in a flat steel product of the invention. The carbides formed by Mo with C are particularly fine and thus improve the fineness of the microstructure of the flat steel product of the invention. However, high contents of Mo worsen the hot and cold formability. In order to avoid this in a particularly reliable manner, the Mo content optionally present in a steel of the invention can be restricted to 0.5% by weight.

In order to avoid adverse effects from sulfur and phosphorus on the properties of the steel processed in accordance with the invention, the S content is restricted to a maximum of 0.03% by weight, preferably a maximum of 0.01% by weight, and the P content to a maximum of 0.1% by weight, preferably a maximum of 0.05% by weight.

The N content of the flat steel product of the invention is restricted to not more than 0.1% by weight, especially not more than 0.02% by weight, preferably not more than 0.001% by weight, in order to avoid the formation of any great amounts of Al nitrides. These would worsen the mechanical properties.

The presence of rare earth metals in contents of up to 0.2% by weight contributes to an improvement in resistance to oxidation and to an increase in strength of a flat steel product of the invention. At the same time, contents of rare earth metals have desulphurizing and deoxidizing action. The oxides formed by the respective rare earth metal additionally have grain-refining action and promote a positive texture selection for improved technological properties. Suitable rare earth metals are particularly Ce and La. The positive effects of rare earth metals in the steel of the invention can be exploited in a particularly target-oriented manner when the contents of rare earth metals are in the range of up to 0.05% by weight.

In principle, the carbides formed in each case through the presence of one or more of the elements Ti, Nb, V, Zr, W, Mo contribute to the increase in strength of the steel of the invention.

Si in contents of up to 2% by weight, especially up to 0.5% by weight, likewise promotes deoxidation in the course of melting and increases the strength and corrosion resistance of the steel of the invention. In the case of excessively high contents, the presence of Si, however, reduces the ductility of the steel and the suitability thereof for welding. Typical Si contents of steels of the invention are within the range of 0.1%-0.5% by weight, especially 0.10-0.2% by weight.

The addition of Cr in contents of up to 3% by weight can also bind carbon present in the steel of the invention to give carbides. At the same time, the presence of Cr increases corrosion resistance. The advantageous properties of Cr in the steel of the invention are achieved in a particularly purposeful manner when Cr is present in contents of up to 1% by weight, especially up to 0.5% by weight.

In order to avoid an increase in the recrystallization temperature, the Co content of the steel of the invention is restricted to a maximum of 1% by weight, especially a maximum of 0.5% by weight, preferably a maximum of 0.3% by weight.

Nickel in contents of up to 2% by weight, especially 1% by weight, likewise contributes to an increase in strength and toughness in steel of the invention. Furthermore, Ni increases the corrosion resistance and reduces the proportion of primary ferrite in the microstructure of the steel of the invention. Ni can be exploited in a particularly practicable manner in the steel of the invention at contents of up to 0.5% by weight.

The addition of B can likewise lead to the formation of a fine microstructure which promotes the formability of the steel of the invention. However, excessively high contents of B can impair cold formability and oxidation resistance.

Therefore, the B content of the steel of the invention is restricted to 0.1% by weight, especially up to 0.01% by weight, preferably 0.005% by weight.

Cu in contents of up to 3% by weight improves corrosion resistance in the steel of the invention, but can also worsen hot formability and weldability in the case of higher contents. If present, therefore, the Cu content in a practicable configuration of the invention is restricted to at most 1% by weight, especially 0.5% by weight.

Ca in contents of up to 0.015% by weight, especially 0.005% by weight or 0.003% by weight, binds sulfur, which could reduce the corrosion resistance, in the steel of the invention.

In the production of a cold-rolled flat steel product of the invention, the following steps are performed in accordance with the invention:

- melting a steel melt having a composition in accordance with the invention, as per the details given above.
- casting the steel melt to give a pre-product, such as a block, a slab, a thin slab or a cast strip. A particularly advantageous method has been found here to be casting to give a cast strip close to the final dimensions. Casting close to the final dimensions can be effected by using conventional casting equipment known per se for this purpose. One example of these is the "twin-roll strip casting machine". Since this method operates with a permanent mold that moves along at the same time, there is no relative movement between the permanent mold and the solidifying strip shell. In this way, these methods can work without casting powder and are therefore of good suitability in principle for producing the preliminary material for production of flat steel products of the invention. Another positive factor in strip casting is that the cast strip is exposed to low mechanical stresses at most before it is cooled, such that the risk of formation of cracks in the high-temperature range is minimized.
  - In the course of melting of the steel melt cast in accordance with the invention, a wait time of at least about 15 minutes should pass between the last addition of alloy and the pouring, in order to assure good mixing of the steel melt. Typical pouring temperatures are in the region of about 1590° C.
  - By practical tests, it has been shown that steels of the invention can also be cast to blocks which can then be rolled out to give slabs by blooming.
- If required, the pre-product is brought to a preheating temperature of 1000-1300° C. or kept within this temperature range, particularly practicable preheating temperatures having been found here to be 1200-1300° C., especially 1200-1280° C. If the pre-product is a slab, the duration over which this preheating proceeds is, for example, 120-240 minutes.
- The pre-product, if appropriate after the optional heating to the preheating temperature, is hot-rolled to give a hot strip, where the rolling end temperature should be more than 820° C., especially more than 850° C., and in practice hot rolling end temperatures of 830-960° C. are established. In practical tests, hot rolling end temperatures in the range of 840-880° C. have been found to be particularly favorable.
- The hot strip obtained is wound to give a coil, where the winding temperature may be up to 750° C., especially up to 650° C. In practice, typical winding temperatures established are 450-750° C., especially 500° C. +/−20° C. The hot strip thus obtained has an average ferrite grain length in the strip core, measured in strip direction, of greater than 100 μm.
- After winding, the hot strip is annealed. This annealing is of particular significance for the properties of the flat steel product produced in accordance with the invention. The hot strip annealing is conducted at an annealing temperature above 650° C. and extending up to 1200° C., especially of 700-900° C. Annealing temperatures of about 850° C., especially 850° C. +/−20° C., have been found to be particularly practicable. The annealing times envisaged for the purpose in this annealing, which is typically conducted as a bell annealing, are typically 1-50 h.
  - As a result of the annealing conducted within the temperature range defined in accordance with the invention, the hot strip, in spite of its high Al contents, can be cold-rolled without occurrence of any significant edge cracks or even strip cracks. The hot strip annealing serves to produce a sufficiently recovered strip core region, to lower the cold rolling resistance and to increase the maximum achievable cold rolling level. A texture selection brought about by the hot strip annealing and a high cold forming level promote the formation of a suitable cold strip texture with the desired profile of properties. A particularly suitable method for hot strip annealing is the bell annealing operation with peak temperatures above 650° C. set according to the variants elucidated above.
- If required, after the annealing, pickling of the hot strip can be conducted, in order to remove residues adhering to the hot strip.
- The annealed and optionally pickled hot strip is then cold-rolled to give a cold-rolled flat steel product. Cold rolling can be effected in one or two stages. In the case of two-stage cold rolling, an intermediate annealing can be conducted in a manner known per se between the cold rolling stages. A two-stage cold rolling with intermediate annealing promotes a positive texture selection.
  - In each case, in the cold rolling, the rolling stage executed before the end of the cold rolling is conducted with a maximum cold forming level. In the case of a one-stage cold rolling, this means that the hot strip is cold-rolled with a cold rolling level of at least 65%, or in the case of two-stage and multistage cold rolling, after the intermediate annealing, a cold rolling level of likewise at least 65% is achieved. In order to achieve optimal rolling results, the two-stage cold rolling can be conducted in such a way that the cold rolling level in the first stage is at least 40% and in the last stage is at least 65%, especially more than 70%, for example at least 80%.

The high cold rolling level of at least 65% in the last cold-rolling stage in each case promotes the formation of a suitable cold strip texture. The effect is particularly marked in the case of Ti/Nb-alloyed materials alloyed in the inventive manner.

After the cold rolling, the cold strip obtained is subjected to an annealing which is executed in a continuous annealing operation or in batchwise mode as a bell annealing. Both the final annealing and the intermediate annealings conducted optionally in the course of cold rolling can be conducted in a conventional manner at temperatures and for annealing times which are known per se. In the final annealing of the cold strip, a material having recrystallized microstructure and advantageous texture is formed. The resultant texture is characterized by a low coverage of the α-fibers of less than 4 and a significant coverage of the γ-fibers of more than 4, which leads to r values greater than 1.3.

The particular annealing of the cold-rolled strip can be effected in continuous conveyor annealing systems with annealing temperatures of 750-850° C. over a typical duration of 1-20 min, and particularly practicable annealing temperatures have been found to be more than 780° C., especially 800-850° C., with an annealing time of 2-5 min. Alternatively, the respective annealing can also be conducted in a bell annealing system in which the annealing temperature is more than 650° C., especially 650-850° C., and the annealing time is 1-50 h. In practice, annealing temperatures of 700-800° C. and an annealing time of 1-30 h have been found to be particularly useful for bell annealing.

Optionally, the cold strip obtained, for example to improve its corrosion resistance, can be covered with a metallic protective layer based, for example on Al or Zn. Suitable methods for this purpose are the coating methods known per se.

To test the invention, three melts of the invention I1, I2 and I3 and two comparative melts C1 and C2 have been melted, and the compositions thereof are reported in table 1.

The steel melts I1 and I2 have been cast to give pre-product in the form of blocks. The blocks have then been heated to a preheating temperature PHT over a preheating period of two hours in each case and then bloomed to give slabs.

Subsequently, the heated slabs have been hot-rolled at a hot rolling end temperature HET to give a hot strip and each hot strip obtained has been wound at a winding temperature WT to give a coil.

By means of a twin-roll strip casting system, a cast strip has been produced as pre-product from the steel melt I3, and then likewise hot-rolled to give a hot strip with a hot rolling end temperature HET. The processing to give a hot strip was effected in a continuous, uninterrupted process sequence which follows on from the strip casting, and so the pre-product obtained on entry into the hot rolling unit already had a temperature within the range of the preheating temperatures defined in accordance with the invention and the preheating was unnecessary. The hot strip produced from the steel I3 has also been wound to give a coil at a winding temperature WT after the hot rolling.

After the winding, the hot strips produced in each case, unless stated otherwise in table 2, have been subjected to annealing in a bell annealing system at an annealing temperature AT for an annealing period of eight hours in each case.

The hot strips thus annealed have each been cold-rolled in one or two stages with cold rolling levels CRL1 (cold rolling level of the first cold rolling stage) and CRL2 (cold rolling level of the respective second cold rolling stage) to give a cold-rolled steel strip. If cold-rolling has been effected in two stages, an intermediate annealing at an intermediate annealing temperature IAT has been conducted in each case between the cold rolling stages. After the cold rolling, the cold-rolled flat steel products have undergone a final annealing at an annealing temperature FAT. The intermediate annealing and the final annealing can each be executed in a continuous run.

The respective preheating temperature PHT, hot rolling end temperature HET, winding temperature WT, annealing temperature AT, the respective cold rolling levels CRL1 and CRL2, and the respective intermediate annealing temperature IAT and final annealing temperature FAT are reported in table 2.

The mechanical properties "yield point Rp0.2", "tensile strength Rm", "elongation A50", "r value r" and "n value n" determined in the cold-rolled steel strips thus produced are reported in table 3. All mechanical/technological parameters were determined in transverse direction. In addition, table 3 reports the maximum values for the coverage of the α- and γ-fibers.

It is found that the cold-rolled steel strips produced in the inventive manner from the steels I1 and I2 of the composition of the invention have yield points of regularly greater than 300 MPa, especially greater than 320 MPa, and at the same time reach values of 380 MPa or more, and tensile strengths of regularly greater than 460 MPa, especially greater than 480 MPa, and at the same time reach values of 530 MPa or more, and elongation values A50 of at least 18%, which regularly reach more than 21% and are especially greater than 25%, and at the same time always have r values of 1.3 or greater.

Cold-rolled steel strips having a composition not in accordance with the invention do not achieve such r values even when these steel strips have been produced employing production parameters closely matched to the parameters which have been established in the production of the cold-rolled flat steel products of the invention. Nor do flat steel products which have a composition in accordance with the invention but have not been processed in accordance with the invention achieve the properties of flat steel products produced in accordance with the invention, or they cannot even be cold-rolled.

The steel strips produced in accordance with the invention accordingly have, in spite of their high Al contents, superior suitability for deep drawing, without any requirement for complex alloying or process technology measures for the purpose.

A flat steel product having optimal forming properties ($r \approx 2$, $n \approx 0.2$, $A50 \approx 30\%$) is attained through a combination of alloy of the invention, high cold forming level and low hot rolling temperature (about 850° C.)

The cold-rolled steel strips produced in the inventive manner from the steels of the invention contain, as well as an Fe(Al) solid solution matrix, local occurrences of a hardening initial order phase. In the case of standard hot rolling parameters, rolling is effected in the fully ferritic phase region, and hot strip is obtained with a typical three-layer microstructure which is again characterized by recrystallized globulitic edge regions and the merely recovered core region with columnar crystals. The hot strip annealing conducted in accordance with the invention reduces the dislocation density in the recovered region and facilitates subsequent processing by cold rolling. Without the hot strip annealing the alpha-fiber texture component is significant, but is less marked with hot strip annealing. A low maximum cold rolling level of up to 50% leads to minor gamma-fiber texture components, but a one-stage cold rolling with a high cold rolling level of at least 65%, especially at least 80%, or a cold rolling conducted in two stages with correspondingly high forming in the last rolling stage leads to a significant gamma fiber component. These dependences are more significant in the case of comparatively low hot rolling end temperatures in the range of 830-960° C., especially 840-880° C.

The forming characteristics of the cold-rolled flat steel product obtained are affected to a crucial degree by the texture. High r and n values and a high elongation at break A50 occur particularly when the gamma-fiber texture component is dominant over the alpha-fiber texture component. A combination of Nb and Ti contents within the inventive scope, the hot strip annealing stipulated in accordance with the invention and the cold rolling parameters provided in accordance with the invention ensure that this aim is achieved.

TABLE 1

| | C | Si | Mn | P | S | Cr | Mo | Ni | Al | N | Ti | Nb | V | % Ti/% Nb |
|---|---|---|---|---|---|---|---|---|---|---|---|---|---|---|
| I1 | 0.018 | 0.09 | 0.08 | 0.006 | 0.003 | 0.04 | 0.00 | 0.03 | 7.1 | 0.0048 | 0.180 | 0.100 | 0.004 | 1.8 |
| I2 | 0.017 | 0.11 | 0.09 | 0.005 | 0.003 | 0.09 | 0.00 | 0.03 | 8.5 | 0.0039 | 0.210 | 0.110 | 0.003 | 1.91 |
| I3 | 0.012 | 0.33 | 0.21 | 0.010 | 0.003 | 1.11 | 0.04 | 0.35 | 6.93 | 0.0020 | 0.262 | 0.120 | 0.010 | 2.18 |
| C1 | 0.007 | 0.18 | 0.09 | 0.050 | 0.003 | 0.03 | 0.01 | 0.03 | 7.2 | 0.0056 | 0.060 | 0.002 | 0.003 | 30 |
| C2 | 0.006 | 0.15 | 0.11 | 0.006 | 0.002 | 0.03 | 0.00 | 0.05 | 9.7 | 0.0051 | 0.070 | 0.004 | 0.004 | 17.5 |

Content figures in % by weight, balance: iron and unavoidable impurities

TABLE 2

| Steel | PHT [° C.] | HET [° C.] | WT [° C.] | AT [° C.] | CRL1 [%] | IAT [° C.] | CRL2 [%] | FAT [° C.] | Inventive? |
|---|---|---|---|---|---|---|---|---|---|
| I1 | 1250 | 850 | 500 | — | not cold-rollable without cracking | | | | NO |
| I1 | 1250 | 850 | 500 | 850 | 50 | — | — | 830 | NO |
| I1 | 1250 | 860 | 500 | 850 | 50 | 830 | 70 | 830 | YES |
| I1 | 1250 | 870 | 500 | 850 | 80 | — | — | 830 | YES |
| I1 | 1250 | 955 | 700 | — | 50 | — | — | 830 | NO |
| I1 | 1250 | 940 | 700 | 850 | 50 | — | — | 830 | NO |
| I1 | 1250 | 940 | 700 | — | 50 | 830 | 70 | 830 | NO |
| I1 | 1250 | 935 | 700 | 850 | 50 | 830 | 70 | 830 | YES |
| I1 | 1250 | 930 | 700 | — | 80 | — | — | 830 | NO |
| I1 | 1250 | 955 | 700 | 850 | 80 | — | — | 830 | YES |
| I2 | 1250 | 880 | 500 | — | not cold-rollable without cracking | | | | |
| I2 | 1250 | 880 | 500 | 850 | 80 | | | 830 | YES |
| I2 | 1250 | 870 | 700 | 850 | 50 | 830 | 70 | 830 | YES |
| I3 | — | 860 | 600 | 850 | 80 | — | — | 830 | YES |
| C1 | 1250 | 930 | 700 | — | not cold-rollable without cracking | | | | NO |
| C1 | 1250 | 930 | 700 | 850 | 80 | — | — | 830 | NO |
| C2 | 1250 | 980 | 700 | 850 | not cold-rollable without cracking | | | | NO |

TABLE 3

| | Mechanical/technological properties | | | | | Maximum value for texture component (S = 0.1) | | |
|---|---|---|---|---|---|---|---|---|
| | | | | | | | γ-fibers | |
| Steel | Rp0.2 [MPa] | Rm [MPa] | A50 [%] | r | n | α-fibers | {111}<011> {111}<112> | Inventive? |
| I1 | not cold-rollable without cracking | | | | | | | NO |
| I1 | 353 | 507 | 28.0 | 0.48 | 0.17 | 4 | 4 | NO |
| I1 | 346 | 502 | 27.0 | 1.36 | 0.18 | 3 | 6 | YES |
| I1 | 329 | 488 | 29.5 | 2.05 | 0.19 | 1 | 5 | YES |
| I1 | 421 | 521 | 19.0 | 0.8 | 0.13 | 12 | 2 | NO |
| I1 | 368 | 503 | 19.9 | 0.86 | 0.15 | 2 | 1.5 | NO |
| I1 | 363 | 523 | 21.9 | 1.03 | 0.17 | 12 | 6 | NO |
| I1 | 324 | 471 | 18.9 | 1.73 | 0.19 | 2 | 4 | YES |
| I1 | 373 | 529 | 23.4 | 1.09 | 0.17 | 8 | 5 | NO |
| I1 | 325 | 461 | 21.1 | 1.70 | 0.17 | 3 | 5 | YES |

TABLE 3-continued

| Steel | Mechanical/technological properties Rp0.2 [MPa] | Rm [MPa] | A50 [%] | r | n | α-fibers | Maximum value for texture component (S = 0.1) γ-fibers {111}<011> {111}<112> | Inventive? |
|---|---|---|---|---|---|---|---|---|
| I1 | not cold-rollable without cracking | | | | | | | NO |
| I2 | 406 | 556 | 18.3 | 1.93 | 0.17 | 2 | 5 | YES |
| I2 | 391 | 537 | 21.8 | 1.56 | 0.14 | 3 | 5 | YES |
| I3 | 451 | 588 | 18.2 | 1.71 | 0.18 | 1 | 5 | YES |
| C1 | not cold-rollable without cracking | | | | | | | NO |
| C1 | 408 | 532 | 22.0 | 0.72 | 0.15 | 9 | 2 | NO |
| C2 | not cold-rollable without cracking | | | | | | | NO |

The invention claimed is:

1. A cold-rolled flat steel product for deep drawing applications, comprising in addition to iron and unavoidable impurities, in % by weight:

C: 0.015%-0.1%,
Al: 6.5%-12%,
Nb: 0.1%-0.2%,
Ti: 0.15%-0.5%,
P: up to 0.1%,
S: up to 0.03%,
N: up to 0.1%,
Mn: up to 1%,
rare earth metals: up to 0.2%,
Si: up to 2%,
Zr: up to 1%,
V: up to 1%,
W: up to 1%,
Mo: up to 1%,
Cr: up to 3%,
Co: up to 1%,
Ni: up to 2%,
B: up to 0.1%,
Cu: up to 3%, and
Ca: up to 0.015%,
wherein % Ti/% Nb ratio of Ti content, % Ti, and Nb content, % Nb, is 1.5≤% Ti/% Nb≤2.5,
wherein the cold-rolled flat steel product has an r value of 1.3 or more, and a texture comprising a coverage of α-fibers of less than 4 and a coverage of γ-fibers of more than 4.

2. The flat steel product as claimed in claim 1, wherein the Al content thereof is 6.5%-10% by weight.

3. The flat steel product as claimed in claim 1, wherein the Al content thereof is more than 6.8% by weight.

4. The flat steel product as claimed in claim 1, wherein the C content thereof is not more than 0.05% by weight.

5. The flat steel product as claimed in claim 1, wherein the Nb content thereof is 0.1%-0.15% by weight.

6. The flat steel product as claimed in claim 1, wherein the Ti content thereof is 0.15%-0.3% by weight.

7. The flat steel product as claimed in claim 1, wherein its microstructure contains 0% to 0.1% by volume of κ-carbides.

8. The flat steel product as claimed in claim 1, wherein grains in its microstructure have a ratio of grain lengths in rolling direction to grain width in transverse direction of the flat steel product of <1.5.

9. A method for producing a cold-rolled flat steel product of claim 1 for deep drawing applications, comprising:

melting a steel melt comprising in addition to iron and unavoidable impurities, in % by weight:

C: 0.015%-0.1%,
Al: 6.5%-12%,
Nb: 0.1%-0.2%,
Ti: 0.15%-0.5%,
P: up to 0.1%,
S: up to 0.03%,
N: up to 0.1%,
Mn: up to 1%,
rare earth metals: up to 0.2%,
Si: up to 2%,
Zr: up to 1%,
V: up to 1%,
W: up to 1%,
Mo: up to 1%,
Cr: up to 3%,
Co: up to 1%,
Ni: up to 2%,
B: up to 0.1%,
Cu: up to 3%, and
Ca: up to 0.015%,
wherein % Ti/% Nb ratio of Ti content, % Ti, and Nb content, % Nb, is 1.5≤% Ti/% Nb≤2.5, casting the steel melt to give a pre-product;

optionally heating or holding the pre-product at a preheating temperature of 1000-1300° C.;

hot-rolling the pre-product with a hot-rolling end temperature of 820-1000° C. to give a hot strip;

winding the hot strip with a winding temperature in the range from room temperature to 750° C. to give a coil;

annealing the hot strip after winding at an annealing temperature of more than 650° C. and up to 1200° C. over an annealing time of 1-50 hours;

optionally pickling the annealed hot strip;

cold-rolling the annealed and optionally pickled hot strip in one or more stages having a total cold-rolling level of at least 65%; and final annealing at a final annealing temperature of 650-850° C.;

to produce the cold-rolled flat steel product having an r value of 1.3 or more, and a texture comprising a coverage of α-fibers of less than 4 and a coverage of γ-fibers of more than 4.

10. The method as claimed in claim 9, wherein the pre-product is a cast strip.

11. The method as claimed in claim 9, wherein the hot rolling end temperature is 830-960° C.

12. The method as claimed in claim 9, wherein the winding temperature is 450-750° C.

13. The method as claimed in claim 9, wherein the annealing the hot strip after winding is conducted as a bell annealing.

14. The method as claimed in claim 9, wherein the cold rolling is conducted in two or more stages and intermediate annealing is effected between the cold-rolling stages.

* * * * *